US012276122B2

(12) United States Patent
Gneckow, Jr.

(10) Patent No.: US 12,276,122 B2
(45) Date of Patent: Apr. 15, 2025

(54) CARPET TILE LIFTING APPARATUS AND SYSTEM FOR REMOVING CARPET TILES

(71) Applicant: Elwood Louis Gneckow, Jr., Royal Oak, MI (US)

(72) Inventor: Elwood Louis Gneckow, Jr., Royal Oak, MI (US)

( * ) Notice: Subject to any disclaimer, the term of this patent is extended or adjusted under 35 U.S.C. 154(b) by 532 days.

(21) Appl. No.: 17/364,158

(22) Filed: Jun. 30, 2021

(65) Prior Publication Data

US 2021/0324643 A1 Oct. 21, 2021

Related U.S. Application Data

(63) Continuation-in-part of application No. 17/341,796, filed on Jun. 8, 2021, which is a continuation-in-part of application No. 17/234,219, filed on Apr. 19, 2021.

(51) Int. Cl.
*E04G 23/00* (2006.01)

(52) U.S. Cl.
CPC ..... *E04G 23/006* (2013.01)

(58) Field of Classification Search
CPC . E04G 23/006; B32B 43/006; B32B 2419/00; B66D 1/12; B66D 1/28; B66D 1/60; Y10T 156/1168; Y10T 156/1978; Y10S 156/929; Y10S 156/94
See application file for complete search history.

(56) References Cited

U.S. PATENT DOCUMENTS 5,456,794 A * 10/1995 Barrett ..... A47G 27/0487 156/763
5,909,868 A * 6/1999 Galella ..... E04G 23/006 254/211
7,032,886 B1 * 4/2006 Kraft ..... E04G 23/006 254/210
10,132,094 B1 * 11/2018 Gneckow, Jr. ..... B66D 1/12
2006/0180799 A1 * 8/2006 Rannikko ..... E04G 23/006 254/202
2018/0334820 A1 * 11/2018 Gneckow, Jr. ..... B66D 1/60
2021/0238873 A1 * 8/2021 Gneckow, Jr. ..... E04G 23/006
2021/0293041 A1 * 9/2021 Gneckow, Jr. ..... E04G 23/006

FOREIGN PATENT DOCUMENTS

JP 2009144459 A * 7/2009

OTHER PUBLICATIONS

Translation of JP-2009144459-A, Jul. 2009, Hishida M (Year: 2009).*

* cited by examiner

*Primary Examiner* — George R Koch
(74) *Attorney, Agent, or Firm* — Jacob M. Ward; Ward Law Office LLC

(57) ABSTRACT

A carpet tile lifting apparatus is disclosed comprises a base plate and a base plate cover coupled to each other via a snap-fit locking mechanism. The base plate is provided with a front cutting edge in a form of a pointed spike to slide underneath the carpet tile. The apparatus comprises two wings coupled at either side of the base plate cover. Further, the wings comprise a first blade and a second blade coupled with each other. The apparatus comprises a housing coupled with the at least one wing. The housing encloses a plurality of wheels coupled to the housing via a first shaft. The first shaft is coupled to a first gear. The apparatus comprises at least one spiked roller coupled with the second shaft and interlocked between the first end and the second end of the housing.

22 Claims, 7 Drawing Sheets

CARPET TILE LIFTING APPARATUS AND SYSTEM FOR REMOVING CARPET TILES

CROSS-REFERENCE TO RELATED PATENT APPLICATION

This application is a continuation-in-part of U.S. application Ser. No. 17/341,796 filed on Jun. 8, 2021, titled "Carpet Pulling Apparatus And System For Removing Carpet" currently pending which is a continuation-in-part of U.S. application Ser. No. 17/234,219 filed on Apr. 19, 2021, titled "A Carpet Cutting Apparatus and A Method and System for Removing Carpet Bonded To A Floor" currently pending. All of these applications are incorporated herein by reference in its entirety.

TECHNICAL FIELD

The present invention generally relates to apparatus for the removal of carpet tiles glued to a floor, and more particularly, relates to a carpet tile lifting apparatus, and system for removing carpet tile from the floor.

BACKGROUND

Modern carpets for floor spacing of offices, homes, residential or commercial industries use carpet of different shapes and designs such as carpet tiles which are generally rectangular or square shaped carpets of small dimensions. These carpet tiles are glued or fixed to the floor using commonly available adhesives/fixing material. The removal of these carpet tiles thus becomes a challenging task every time when the floor is redecorated or resurfaced. The removal of these carpet tiles is done by using carpet cutters. Essentially, the cutter makes it possible to trim and cut the carpet tile in order to ensure proper removal. There are a number of different designs for the carpet cutter, ranging from simple devices that employ a single blade to larger carpet tools that make use of multiple blades.

A carpet cutter is a type of utility knife, which is a commonly used hand tool specifically used for cutting carpet or a rug. A conventional carpet knife has a housing made up of a right cover and a left cover detachably coupled together by a screw or threaded wheel to form the housing, comprising a handle and a blade chamber. The blade chamber carries a cutting blade. The blade chamber has a slot that allows the blade to move into an active cutting position. The housing may hold spare blades, which are accessible upon detachment of the right and left covers.

Further, the installation of carpeting on the floors of homes, office buildings, theatres and the like usually require a considerable amount of trimming or cutting. In the case of wall-to-wall carpeting, for example, the outer edges of the carpeting must be carefully trimmed to conform to the shape of the floor that is being covered; and confronting edges of adjacent widths of the carpeting must be carefully matched to avoid unsightly seams.

A prior art U.S. Pat. No. 4,833,956A to Roberts discloses a vertically spaced carpet cutter for cutting overlapped carpet sections to be abutted. The cutter comprises a body, flat longitudinally extending base plate extending downward from the body and adapted to be drawn across the floor, and a handle extending upwardly from the plate for drawing the plate across the floor. Upper, lower and intermediate, elongated guides are spaced vertically below the handle and above the undersurface of the base plate forming a pair of vertically spaced, one-above-the-other, parallel, upper and lower, horizontally extending, longitudinal slots between the guides. A pair of overlapping carpet portions are respectively positioned in the slots. The carpet portions have a sliding engagement with the guides for maintaining alignment of the overlapped carpet portions suitable for making simultaneous, parallel, one-above-the-other, abutting cuts with the same stroke to concurrently sever the carpet backings of the overlapping carpet portions, so that the severed edges can be joined to provide an invisible seam. A blade attached to the body of the cutter in a configuration adjacent the guides have its cutting-edge intersecting with each horizontally extending, longitudinal slot for severing the carpet backings, as the base plate is drawn across the floor. A pair of oppositely diverging blades can be included for either right hand or left-hand usage, and the tool can be powered with a driven circular cutting blade. However, unlike the subject matter of the claimed invention, Roberts fails to disclose the removal of a plurality of carpets tiles in a single motion of the tool using a winch or a diverter pad and a cable.

In view of the deficiencies and drawbacks in the prior art, it is the primary object of the present invention to provide an improved carpet cutter assembly presented with superior efficiency for lifting and removing a plurality of carpet tiles and is driven by a motorized winch.

SUMMARY OF THE INVENTION

According to a preferred embodiment of the present invention, a primary objective of the invention is to provide a carpet tile lifting apparatus or carpet tile lifter to lift and remove carpet tiles glued or fixed to a floor. The carpet tile lifter is user-friendly and lifts a plurality of carpet tiles simultaneously. The carpet tile lifter comprises a base plate and a base plate cover coupled to each other via a snap-fit locking mechanism. Further, the base plate is provided with a front cutting edge in a form of a pointed spik which is configured to slide underneath the carpet tile. The front cutting edge lifts at least two carpet tile corners simultaneously. Further, the carpet tile lifter comprises at least one wing coupled at one end with the base plate cover using a first plurality of screws. Further, the at least one wing comprises a first blade and a second blade coupled with each other using a second plurality of screws. Further, the first blade is coupled with the base plate cover via the first plurality of screws. Further, the base plate is configured to press against a carpet tile and the at least one wing is configured to lift the carpet tile rearwards.

Further, the carpet tile lifter comprises a housing coupled with the at least one wing. The housing encloses a plurality of wheels coupled to a first end and a second end of the housing via a first shaft. Further, the first shaft is coupled to a first gear. Further, the first gear is interfaced with a second gear transversely. The carpet tile lifter further comprises a second shaft coupled with the second gear. The second shaft is coupled between the first end and the second end of the housing. Further, the carpet tile lifter comprises at least one spiked roller coupled with the second shaft and interlocked between the first end and the second end of the housing. Further, the plurality of wheels impart motion to the at least one spiked roller via the first gear and the second gear, and the at least one spiked roller pulls the lifted carpet tile out of the carpet tile lifter. Such use of carpet tile lifter facilitates the removal of carpet tiles from the floor by lifting up at least two carpet tiles simultaneously.

In one embodiment of the present invention, the carpet tile lifter comprises a lockable swivel integrated on the base plate cover and interfaced with the first shaft at the first end. Further, at least one handle coupled with the lockable swivel via a pole handle. The at least one handle is configured to guide the plurality of wheels to keep the base plate and the at least one wing between the carpet tile and the floor. Further, the at least one handle is configured to apply downward pressure to assist the plurality of wheels in turning and thereby keep the base plate and the at least one wing firmly onto the floor. Further, the at least one handle is configured to move the base plate and the at least one wing, after the carpet tile is being lifted off the floor.

In one alternate embodiment of the present invention a carpet tile lifting system is disclosed. The system comprises a carpet tile lifter having a clamping hook integrated at one side of a base plate. Further, the system includes a carpet removing apparatus having a motorized winch coupled to the clamping hook of the base plate via a cable. The carpet removing apparatus is configured to pull the carpet tile lifter via the cable, and the cable is attached to the motorized winch at a first end and to the clamping hook at a second end. Further, the carpet tile lifter is configured to slide between a carpet tile and a floor to which the carpet tile is glued, and the carpet removing apparatus is configured to impart motion to the carpet tile cutter via the cable using the motorized winch.

To further clarify advantages and features of the present invention, a more particular description of the invention will be rendered by reference to specific 15 embodiments thereof, which is illustrated in the appended drawings. It is appreciated that these drawings depict only typical embodiments of the invention and are therefore not to be considered limiting of its scope. The invention will be described and explained with additional specificity and detail with the accompanying drawings.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

Figure 1:
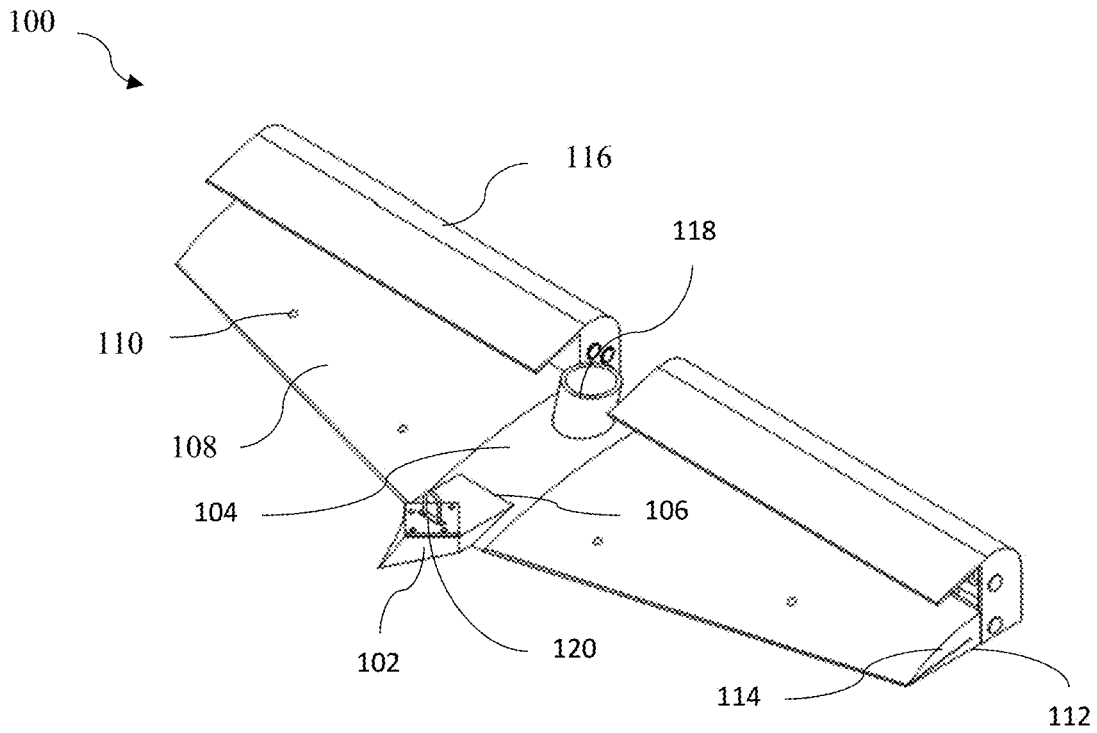
FIG. 1 illustrates an isometric view of a carpet tile lifter, according to an embodiment of the present invention.

Further, skilled artisans will appreciate that elements in the drawings are illustrated for simplicity and may not have necessarily been drawn to scale. For example, the flow charts illustrate the method in terms of the most prominent steps involved to help to improve understanding of aspects of the present invention. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having benefit of the description herein.

DETAILED DESCRIPTION OF THE INVENTION

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated system, and such further applications of the principles of the invention as illustrated therein being contemplated as would normally occur to one skilled in the art to which the invention relates.

It will be understood by those skilled in the art that the foregoing general description and the following detailed description are exemplary and explanatory of the invention and are not intended to be restrictive thereof.

Reference throughout this specification to "an aspect", "another aspect" or similar language means that a particular feature, structure, or characteristic described in connection with the embodiment is included in at least one embodiment of the present invention. Thus, appearances of the phrase "in an embodiment", "in another embodiment" and similar language throughout this specification may, but do not necessarily, all refer to the same embodiment.

The terms "comprises", "comprising", or any other variations thereof, are intended to cover a non-exclusive inclusion, such that a process or method that comprises a list of steps does not include only those steps but may include other steps not expressly listed or inherent to such process or method. Similarly, one or more devices or sub-systems or elements or structures or components proceeded by "comprises . . . a" does not, without more constraints, preclude the existence of other devices or other sub-systems or other elements or other structures or other components or additional devices or additional sub-systems or additional elements or additional structures or additional components.

Unless otherwise defined, all technical and scientific terms used herein have the same meaning as commonly understood by one of ordinary skill in the art to which this invention belongs. The system, methods, and examples provided herein are illustrative only and not intended to be limiting.

Embodiments of the present invention will be described below in detail with reference to the accompanying drawings.

FIG. 1 illustrates an isometric view of a carpet tile lifter or carpet tile lifting apparatus 100, according to an embodiment of the present invention. The carpet tile lifter 100 is described in conjunction with FIG. 2, FIG. 3, FIG. 4, FIG. 5, and FIG. 6A-6F. The carpet tile lifter 100 may be employed for lifting and removing carpet tiles off a floor. Further, the carpet tile lifter 100 may be provided to lift a plurality of carpet tiles simultaneously. In one embodiment, the carpet tile lifter 100 may be manually operated using a handle. In another exemplary embodiment, the carpet tile lifter 100 may be self-motorized. In another exemplary embodiment, the carpet tile lifter 100 may be operated using a remote motorized winch. Further, the carpet tile lifter 100 may comprise a base plate 102, a base plate cover 104, a snap-fit locking mechanism 106, at least one wing 108, a first plurality of screws (not shown), a second plurality of screws 110, a first blade 112, a second blade 114, and a housing 116.

As shown in FIG. 1, the base plate 102 and the base plate cover 104 may be coupled to each other using a snap fit locking mechanism. The base plate 102 may be disposed at center of the carpet tile lifter 100, and the base plate cover 104 may be disposed over the base plate 102 using the snap-fit locking mechanism. Further, the base plate 102 may comprise a front cutting edge 120 which may be configured to slide underneath the carpet tile, and thereby lift the carpet tile from the floor.

Further, the at least one wing 108 may be coupled at one end with the base plate cover 104 using the first plurality of screws 110. Further, the at least one wing 108 may comprise the first blade 112 and the second blade 114. In an embodiment, the first blade 112 and the second blade 114 may be coupled with each other using the second plurality of screws 110. Further, the first blade 112 may be coupled with the base plate cover 104 using the first plurality of screws 110. In one embodiment, the base plate 102 may be configured to press against a carpet tile. Further, the at least one wing 108 may be configured to lift the carpet tile rearwards. Further, the housing 116 may be coupled with the at least one wing 108. Further, the housing 116 may comprise a plurality of wheels which may be coupled to a first end and a second end of the housing 116 using a first shaft. Further, the carpet tile lifter 100 may further comprise a first gear which may be coupled to the first shaft and a second gear which may be interfaced with the first gear in a transverse direction. In an embodiment, a second shaft may be coupled with the second gear. In one embodiment, the second shaft may be coupled between the first end and the second end of the housing 116. Additionally, at least one spiked roller may be coupled with the second shaft and may be interlocked between the first end and the second end of the housing 116. In one embodiment, the plurality of wheels may impart motion to the at least one spiked roller using the first gear and the second gear. Further, the at least one spiked roller may pull the lifted carpet tile out of the carpet tile lifter.

Figure 4:
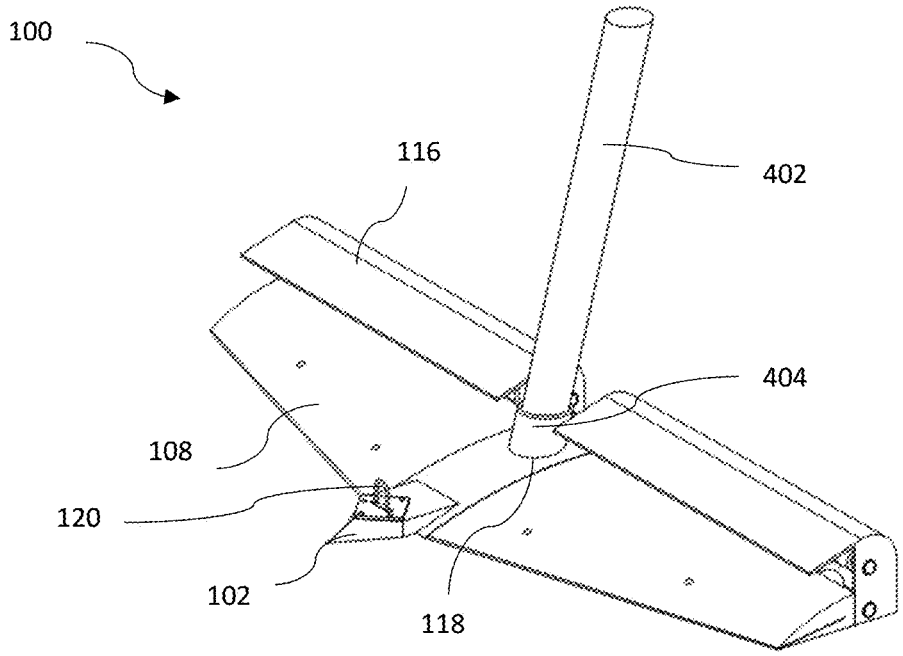
FIG. 4 illustrates an isometric view of the carpet tile lifter coupled with a handle, according to an embodiment of the present invention.

The carpet tile lifter 100 may further comprise a lockable swivel 118 integrated on the base plate cover 104 and may be interfaced with the first shaft at the first end of the housing 116. In one exemplary embodiment, the lockable swivel 118 may be configured to receive at least one handle (as shown in FIG. 4) to guide the plurality of wheels. Further, the carpet tile lifter 100 may be provided with a clamping hook 120 coupled at one end of the base plate 102. In one embodiment, the clamping hook 120 may be provided to be coupled with a winch or trolley to pull the carpet tile lifter 100 forwards while lifting carpet tiles from the floor.

Figure 2:
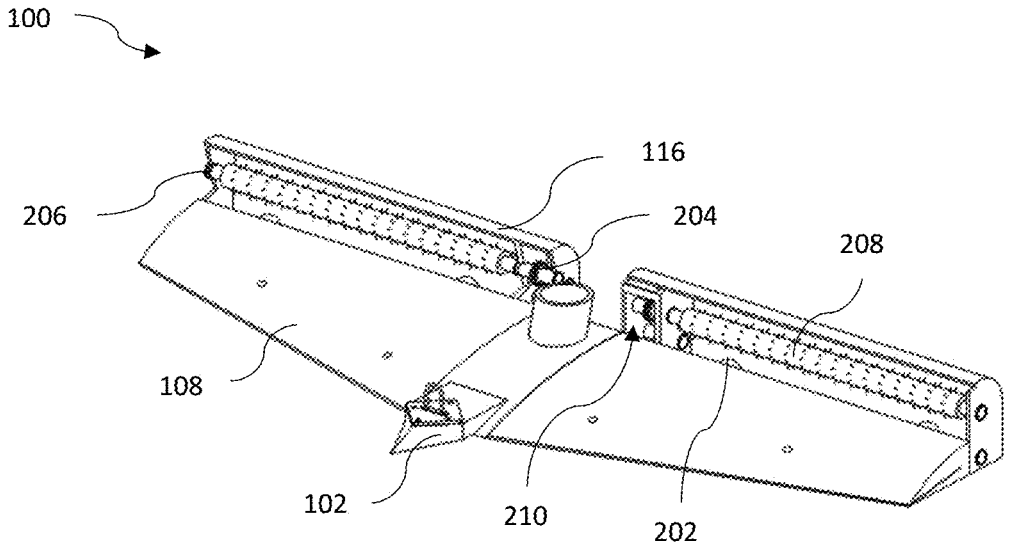
FIG. 2 illustrates another isometric view of the carpet tile lifter, according to an embodiment of the present invention.

FIG. 2 illustrates another isometric view of the carpet tile lifter 100, according to an embodiment of the present invention. FIG. 2 is described in conjunction with FIG. 1. The carpet tile lifter 100 may further comprise, may comprise the plurality of wheels 202 which may be coupled to the first end and the second end of the housing 116 using the first shaft. In one embodiment, the plurality of wheels 202 may be provided to impart motion to the carpet tile lifter 100, such that the at least one wing 108 may move forwards to lift the carpet tile from the floor. Further, the first shaft may be coupled with the first gear and the second gear 204 may be interfaced with the first gear along the transverse direction. Moreover, the second gear 204 may be coupled with the second shaft. In one embodiment, the second shaft 206 may be coupled between the first end and the second end of the housing 116. Further, the second shaft 206 may be coupled with the at least one spiked roller 208 and may be interlocked between the first end and the second end of the housing 116. In one embodiment, the at least one spiked roller 208 may be configured to have a rotational motion along the second shaft 206. In one embodiment, the second shaft 206 may be configured to receive rotational motion via the second gear which may receive the motion from the first gear. In one embodiment, the plurality of wheels 202 may impart motion to the at least one spiked roller 208 via the first gear and the second gear 204. Further, the housing 116 of the carpet tile lifter 100 may be provided with at least one pocket 210 at the first end of the housing 116. In one embodiment, the at least one pocket 210 may be provided to enclose the first gear (as shown in FIG. 3), and the second gear 204.

Figure 3:
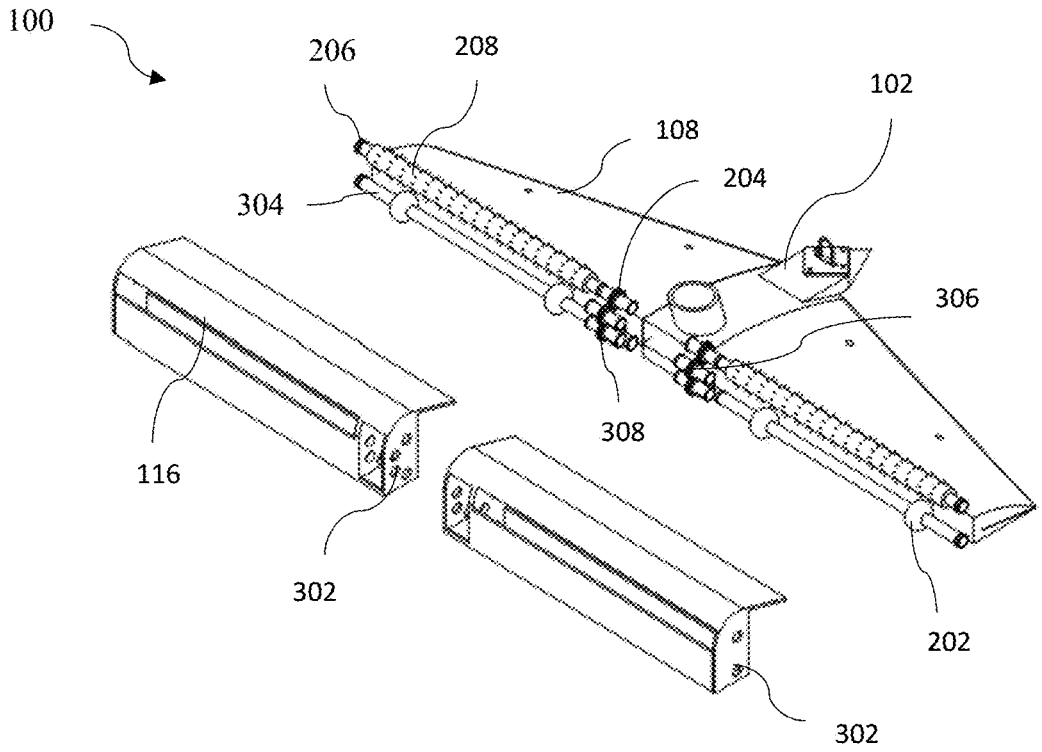
FIG. 3 illustrates an exploded view of the carpet tile lifter, according to an embodiment of the present invention.

FIG. 3 illustrates an exploded view of the carpet tile lifter 100, according to an embodiment of the present invention. FIG. 3 is described in conjunction with FIG. 1 and FIG. 2. The carpet tile lifter 100 may comprise the base plate 102 coupled with the base plate cover 104. Further, the at least one wing 108 may be coupled to the base plate using the first plurality of screws 110. Further, the at least one wing 108 may have the first blade 112, and the second blade 114 coupled to each other using the second plurality of screws 110. Further, the housing 116 may be coupled with the at least one wing 108 and may be provided to cover the at least one spiked roller 208 and the plurality of wheels 202. Further, the housing 116 may be provided with a plurality of provisions 302 at the first end and the second end. In one embodiment, the plurality of provisions may be provided to receive the first shaft 304 and the second shaft 206.

As shown in FIG. 3, the carpet tile lifter 100 may be provided with a third gear 306 which may be interfaced transversely between the first gear 308 and the second gear 204. In one embodiment, the first gear 308 may act as a driver gear to receive motion from the plurality of wheels 202 via the first shaft 304. In another embodiment, the first gear 308 may transmit the motion to the second gear 204 via the third gear 306. In one embodiment, the carpet tile lifter 100 may be provided with at least two wings coupled at both sides of the base plate 102. In another exemplary embodiment, the carpet tile lifter 100 may be provided with at least two housings enclosing at least two spiked rollers between their first end and second end. In one embodiment, the carpet tile lifter 100 may be provided to lift at least two carpet tiles simultaneously using the at least two wings.

FIG. 4 illustrates an isometric view of the carpet tile lifter 100 coupled with a handle, according to an embodiment of the present invention. FIG. 4 is described in conjunction with FIG. 1-3. The carpet tile lifter 100 may be provided with at least one handle 402 coupled with the lockable swivel 118. Further, the at least one handle 402 may be coupled with the lockable swivel 118 using a pole handle 404. In one embodiment, the at least one handle 402 may be configured to guide the plurality of wheels 202 to keep the base plate 102 and the at least one wing 108 between the carpet tile and the floor. In one embodiment, the at least one handle 402 may be provided to control the movement of the carpet tile lifter 100 forwards when the first blade 112 may slide underneath the carpet tile above the floor. In another embodiment, the at least one handle 402 may be provided to control the movement of the carpet tile lifter 100 rearwards when the first blade 112 may slide underneath the carpet tile. In one exemplary embodiment, the at least one handle 402 may be motorized to control the movement of the carpet tile lifter 100.

Figure 5:
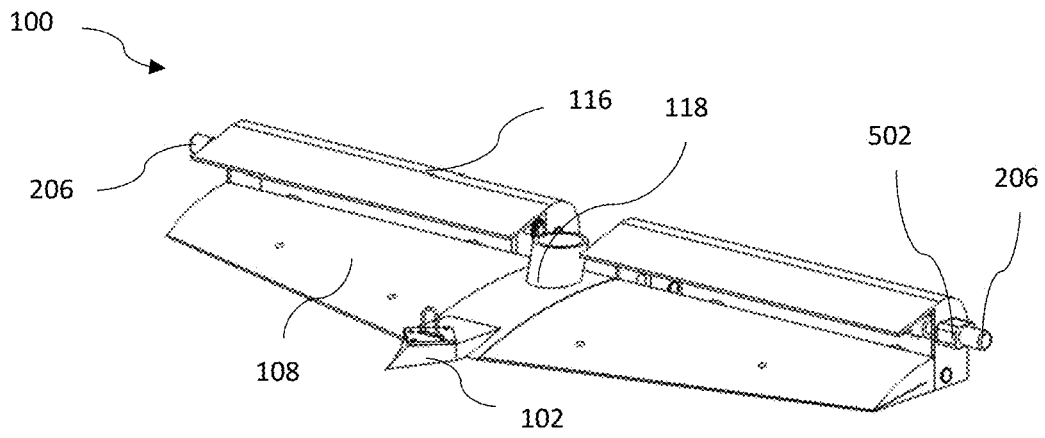
FIG. 5 illustrates a front view of the carpet tile lifter, according to an embodiment of the present invention.

FIG. 5 illustrates a front view of the carpet tile lifter 100, according to an embodiment of the present invention. FIG. 5 is described in conjunction with FIG. 1-4. The second shaft 206 of the carpet tile lifter 100 may be interlocked between the first end and the second end of the housing 116 with the plurality of provisions 302. Further, the second shaft 206 may be tightened with at least one nut 502 provided on an outer side of the first end or the second end of the housing 116. The second shaft 206 may be matted in a manner, that the at least one nut 502 may be placed at one provision of the plurality of provisions 302 at the outer end of the second end of the housing 116 and one end of the second shaft 206 may be received from the one provision. In one embodiment, the one end of the second shaft 206 may be tightened within the at least one nut 502. In another embodiment, the at least one nut 502 may have a threaded inner structure.

FIG. 6A-6F illustrates different components of the carpet tile lifter 100, according to an embodiment of the present invention. FIG. 6A-6F is described in conjunction with FIG. 1-5.

Figure 6A:
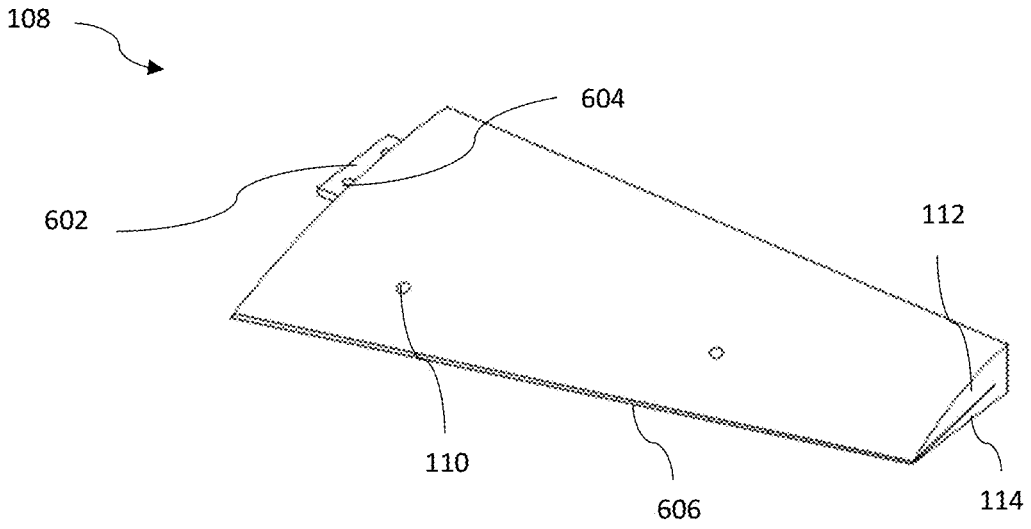
FIG. 6A-6F illustrates different components of the carpet tile lifter, according to an embodiment of the present invention.
Figure 6B:
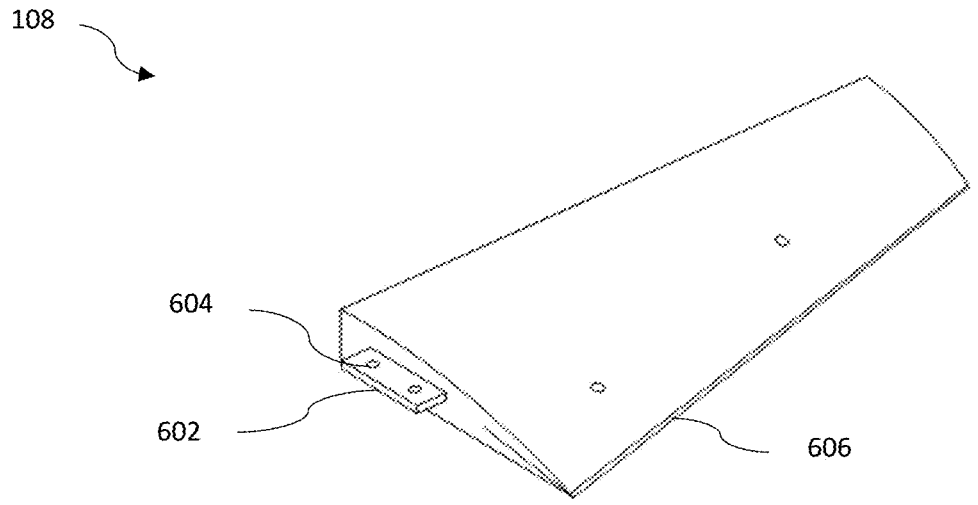

As shown in FIG. 6A-6B, the at least one wing 108 may be provided with the first blade 112 and the second blade 114. Further, the at least one wing may be provided with an extended portion 602 integrated on one side of the at least one wing 108. Further the extended portion 602 may be provided with a first plurality of holes 604. In one embodiment, the at least one wing 108 may be coupled with the base plate 102 using the first plurality of screws 110 via the extended portion 602 and the first plurality of holes 604. Further the first blade 112 and the second blade 114 of the at least one wing 108 may be spaced apart along a transverse direction. Further, the first blade 112 of the at least one wing 108 is configured to slide between the carpet tile and the floor. In one embodiment, the first blade 112 of the at least one wing 108 may comprise a front edge 606. Further the front edge 606 may be a hardened cutting edge which may be configured to slide between the carpet tile and the floor to which the carpet tile may be glued. In one embodiment, the front edge 606 may be an elongated chisel blade. In another embodiment, the front edge 606 may be detachably attached to the at least one wing 108 using the second plurality of screws 110.

Figure 6C:
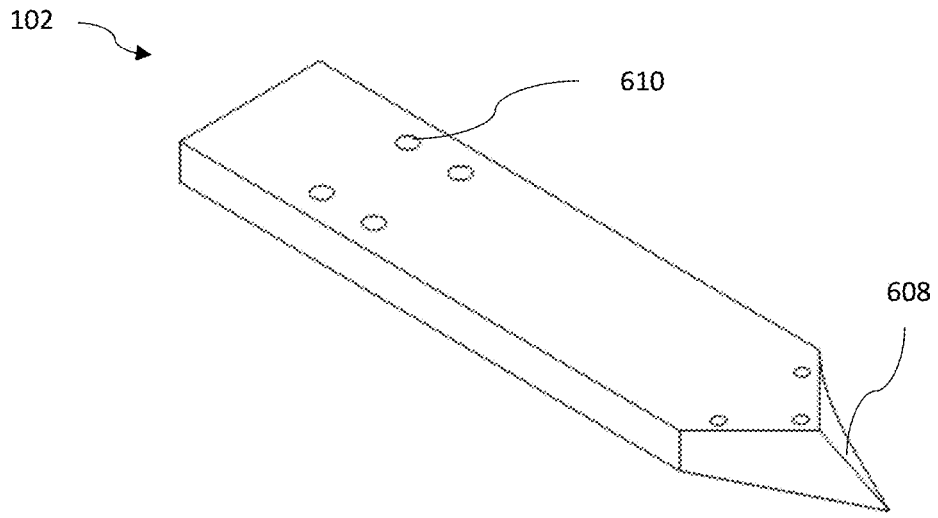

As shown in FIG. 6C, the base plate 102 may be provided with a front cutting edge 608 which may be configured to slide underneath the carpet tile, and thereby lift the carpet tile from the floor. In one exemplary embodiment, the front cutting edge 608 of the base plate 102 may be pointed and sharpened. Further, the base plate may be provided with a second plurality of holes 610 integrated at one side of the base plate 102. In one embodiment, the second plurality of holes 610 may be coupled with the first plurality of holes 604 of the extended portion 602 of the at least one wing 108 using the first plurality of screws 110. In one exemplary embodiment, a first wing may be coupled at one side of the base plate 102 and a second wing may be coupled at second end of the base plate 102. In one embodiment, the clamping hook 120 may be coupled to the base plate 102 using threaded screws.

Figure 6D:
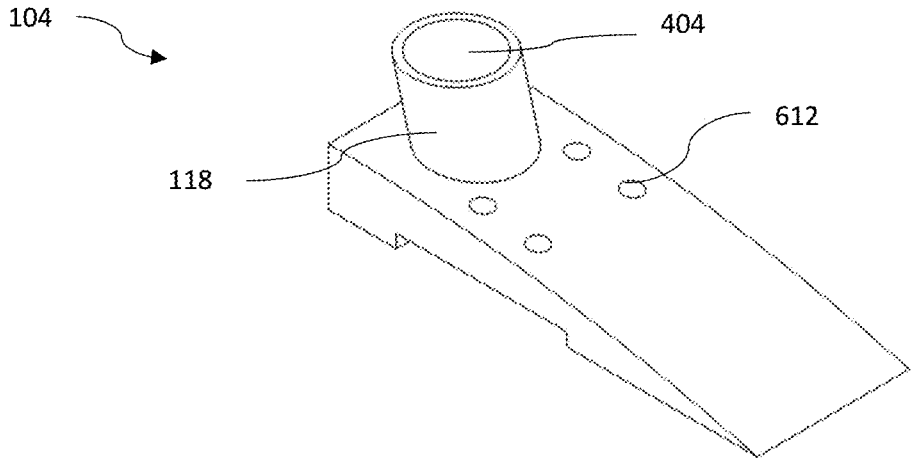

As shown in FIG. 6D, the base plate cover 104 may be provided with a third plurality of holes 612 integrated at one surface of the base plate cover 104. Further, the third plurality of holes 612 may be configured to be coupled with the first plurality of holes 604 of the extended portion 602 of the at least one wing 108 and the second plurality of the holes 610 of the base plate 102 using the first plurality of screws 110. Further, the base plate cover 104 may be provided with the lockable swivel 118 for coupling with the at least one handle 402. Further, the base plate cover 104 may be coupled with the base plate 102.

Figure 6E:
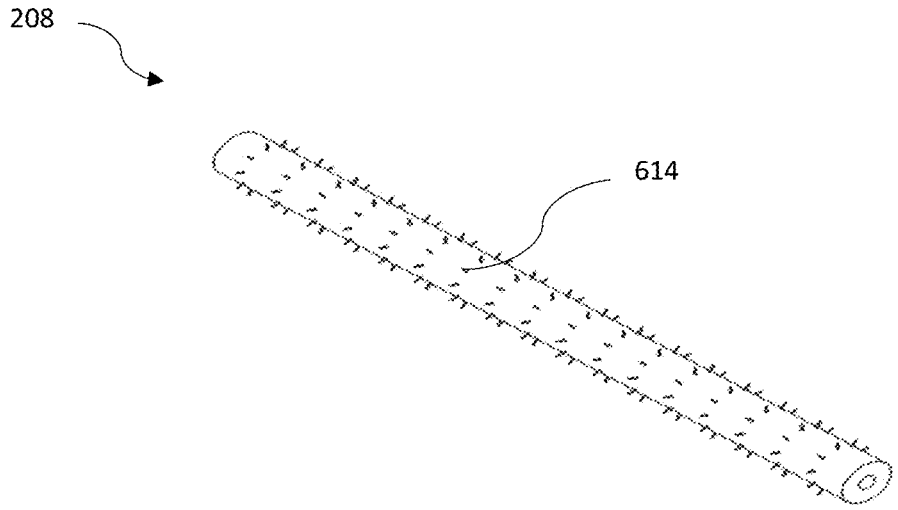

As shown in FIG. 6E, the at least one spiked roller 208 may be provided a plurality of spikes 614 integrated around a circumference of the at least one spiked roller 208. Further, the at least one spiked roller 208 may be provided with a hollow section at a first end and a second end of the at least one spiked roller 208. In one embodiment, the hollow section of the at least one spiked roller 208 may be provided to be coupled with the second shaft 206. Further, the second shaft 206 may be configured to rotate the at least one spiked roller 208 by receiving motion from the second gear 204. In one embodiment, the at least one spiked roller 208 may be provided to receive the carpet tile lifted by the at least one wing 108.

Figure 6F:
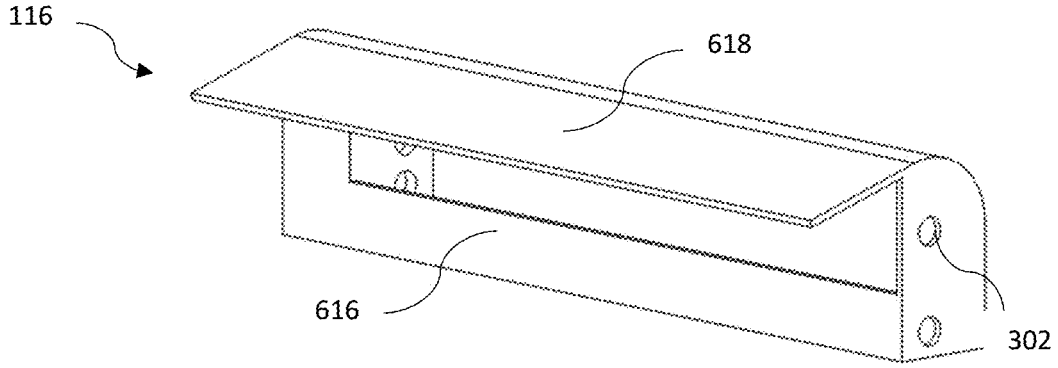

As shown in FIG. 6F, the housing 116 may be provided with a vertical section 616 and a horizontal section 618. Further, the vertical section 616 may be a rectangular box with a front window and the plurality of provisions 302 integrated on both sides of the rectangular box. Further, the horizontal section 618 may be extended forwards over the at least one wing 108.

Figure 7:
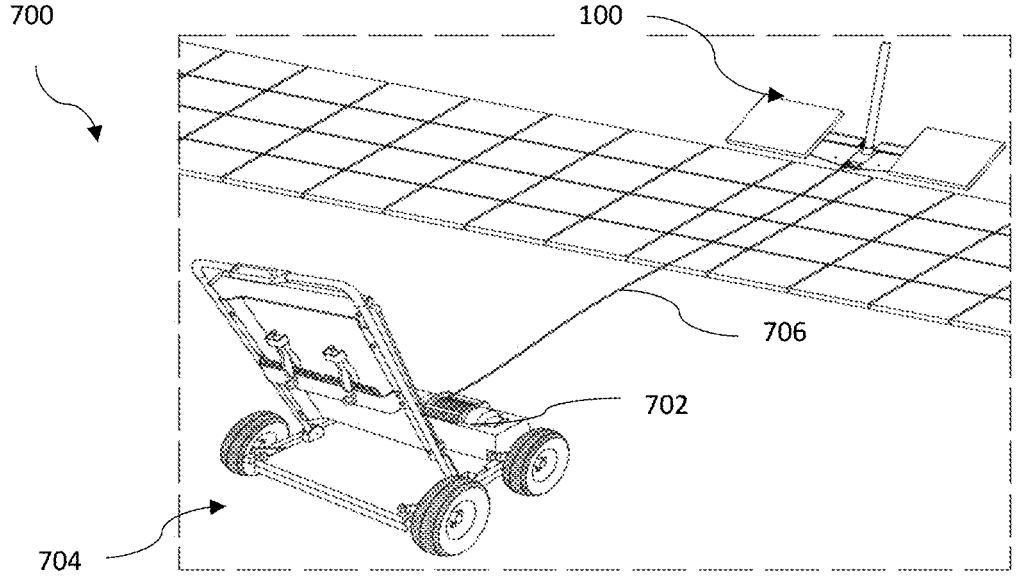
FIG. 7 illustrates the carpet tile lifter coupled with a motorized winch to lift carpet tiles, according to an embodiment of the present invention.

FIG. 7 illustrates the carpet tile lifting system 700 depicting the carpet tile lifter 100 coupled with a motorized winch 702 to lift carpet tiles, according to an embodiment of the present invention. FIG. 7 is described in conjunction with FIG. 1-6. The carpet tile lifter 100 may be provided with the clamping hook 120 integrated at one side of the base plate 102. As shown in FIG. 7, a carpet removing apparatus 704 may be provided with the motorized winch 702 coupled to the clamping hook 120 of the base plate 102 using a cable 706. In one embodiment, the carpet removing apparatus 704 may be configured to pull the carpet tile lifter 100 using the cable 706. In one embodiment, the cable 706 may be attached to the motorized winch 702 at a first end and to the clamping hook 120 at a second end. In another embodiment, the carpet tile lifter 100 may be configured to slide between the carpet tile and the floor to which the carpet tile may be glued. Further, the carpet removing apparatus 704 may be configured to impart motion to the carpet tile lifter 100 via the cable 706 using the motorized winch 702. In one exemplary embodiment, the carpet tile lifter 100 may be self-motorized and thereby may lift and remove carpet tiles from the floor without using motorized winch 702.

In one exemplary embodiment, the at least one wing 108 of the carpet tile lifter 100 may be, but not limited to in three sizes to lift different sizes of carpet tiles from the floor. One for the 12-inch carpet tiles. One for the 18-inch carpet tiles and one for the 24-inch carpet tiles. In one exemplary embodiment, the front edge or tip of the base plate 102 goes between the rows of the two tiles and at least wing 108 has a sharp triangle shaped tip that slides under the carpet tile and starts lifting and separating at least two rows of tiles the off the floor. In one embodiment, the at least one wing 108 may be detachable from the carpet tile lifter 100. Further, the at least one wing 108 may be provided with a slight raised section on the top of the triangle that helps the carpet tile lifter 100 follow the line between the two rows of tiles.

In one alternate embodiment, when the carpet tile lifts off the floor, it may slide across the top of the at least one wing 108 and may be pulled into the housing 116 by the at least one spiked roller 208. Further, the at least one spiked roller 208 may be driven by the plurality of wheels 202 under the carpet tile lifter 100 and consequently that may drive the at least one spiked roller 208. In one embodiment, the plurality of wheels 202 can be more like tracks, so it grips the floor better. Further, when the plurality of wheels 202 may turn, they may drive the first gear 308 that connects to the second gear 204 and then to the at least one spiked roller 208. Further, the motion transmitted via the first gear 308, the second gear 204 and the third gear 306 may keep the at least one spiked roller 208 turning in right direction and may keep a pressure on the lifted carpet tile as it may be pulled through the carpet tile lifter 100. In one embodiment, the at least one spiked roller 208 may be adjustable slightly up and down to accommodate different thicknesses of carpet tiles. In one embodiment, the at least one spiked roller 208 may be configured to pull the carpet tile through the carpet tile lifter 100 so that the base plate 102 and the at least one wing 108 of the carpet tile lifter 100 may continue to dig under the carpet tile to rip it off the floor. In another embodiment, the at least one spiked roller 208 may also move the carpet tile out of the way for a next tile to take its place and hit the at least one spiked roller 208 just as the preceding carpet tile. In one exemplary embodiment, when the carpet tile may be leaving the carpet tile lifter, it may fall onto the floor where it may be then picked up easily.

In one embodiment, as the motorized winch 702 may pull the carpet tile lifter 100 through the rows of carpet tiles, to remove at least two rows at a time which is much faster than conventional tools. In an exemplary embodiment, the at least one wing 108 may be used on just one side of the base plate 102 when there is no other tile on the other side.

In one alternate embodiment, the at least one handle 402 may be mounted to the carpet tile lifter 100 and may be coupled to the lockable swivel 118 where the at least one handle 402 may be locked into any position. The carpet tile lifter 100 may be guided by the at least one handle 402 to keep the base plate 102 and the at least one wing 108 between the rows of tiles. It can be noted that the at least one handle 402 may be used to apply downward pressure on the back of the tool to assist the plurality of wheels 202 in turning and to keep the carpet tile lifter 100 firmly on the floor. In one embodiment, the at least one handle 402 may be used to assist in turning the tool to line it up for the next row to pull up.

In one alternate embodiment, the front edge 606 of the at least one wing 108 of the carpet tile lifter 100 may have a hardened cutting edge that may slide between the carpet tile and the floor it is attached to. Further, the front edge 606 may act as a cutting edge and this cutting edge may be like a long chisel blade. In one embodiment, the front edge 606 may be sharpened, and may be removable from the at least one wing 108 of the carpet tile lifter 100 by loosening the second plurality of screws 110 imbedded in body of the at least one wing 108. In one embodiment, the angle of the front edge 606 may be adjustable by adjusting the second plurality of screws 110.

In one alternate exemplary embodiment, the carpet tile lifter 100 may be referred as a tool or lifting apparatus. Further, the carpet tile lifter 100 may be easily disassembled for easy cleaning. In one exemplary embodiment, the carpet tile lifter 100 may be provided with a storage container to protect cutting edges of the carpet tile lifter 100. In another embodiment, the storage box may also be provided to contain extra cutting blades and elements of the carpet tile cutter 100.

Therefore, it will be apparent for an ordinary person skilled in the art, that from the description above stated, that the carpet tile lifter 100 or may be referred as carpet tile cutter or carpet tile remover, can be used for a variety of applications, such as, but not limited to, the above-mentioned applications. Further, some applications in the field of removing carpet tiles glued to the floor, may be considered as a major aspect of the present carpet tile lifter 100 herein disclosed.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component of any or all the claims.

What is claimed is:

1. A carpet tile lifting apparatus comprising:

a base plate and a base plate cover coupled to each other;

at least one wing coupled at one end with the base plate cover using a first plurality of screws, wherein the at least one wing comprises:

a first blade and a second blade coupled with each other using a second plurality of screws, the first blade is coupled with the base plate cover via the first plurality of screws, wherein the base plate is configured to press against a carpet tile and the at least one wing is configured to lift the carpet tile rearwards;

a housing coupled with the at least one wing, wherein the housing encloses:

a plurality of wheels coupled to a first end and a second end of the housing via a first shaft;

a first gear coupled to the first shaft;

a second gear interfaced with the first gear in a transverse direction;

a second shaft coupled with the second gear, wherein the second shaft is coupled between the first end and the second end of the housing; and at least one spiked roller coupled with the second shaft and interlocked between the first end and the second end of the housing, wherein the plurality of wheels impart motion to the at least one spiked roller via the first gear and the second gear, and the at least one spiked roller pulls the lifted carpet tile out of the carpet tile lifter.

2. The carpet tile lifting apparatus as claimed in claim 1, wherein the apparatus comprises a clamping hook coupled at one side of the base plate using threaded screws.

3. The carpet tile lifting apparatus as claimed in claim 1, wherein the base plate comprises a front cutting edge configured to slide underneath the carpet tile, and thereby lift the carpet tile from a floor.

4. The carpet tile lifting apparatus as claimed in claim 3, wherein the front cutting edge is a sharpened long chisel blade.

5. The carpet tile lifting apparatus as claimed in claim 1, further comprising a lockable swivel integrated on the base plate cover and interfaced with the first shaft at the first end; and at least one handle coupled with the lockable swivel via a pole handle, wherein the at least one handle is configured to guide the plurality of wheels to keep the base plate and the at least one wing between the carpet tile and a floor.

6. The carpet tile lifting apparatus as claimed in claim 5, wherein the at least one handle is configured to apply downward pressure to assist the plurality of wheels in turning and thereby keep the base plate and the at least one wing firmly onto the floor.

7. The carpet tile lifting apparatus as claimed in claim 5, wherein the at least one handle is configured to move the base plate and the wing, after the carpet tile is being lifted off the floor.

8. The carpet tile lifting apparatus as claimed in claim 1, wherein the first gear is configured to receive motion from the plurality of wheels, and transmit the motion to the second gear, which is coupled to the second shaft, to drive the at least one spiked roller.

9. The carpet tile lifting apparatus as claimed in claim 8, wherein the motion transmitted from the second gear to the at least one spiked roller is configured to move the at least one spiked roller in the right direction and keep pressure on the carpet tile as the carpet tile is pulled through the carpet tile lifter.

10. The carpet tile lifting apparatus as claimed in claim 1, wherein the first gear is a drive gear and the second gear is an idler gear.

11. The carpet tile lifting apparatus as claimed in claim 1, wherein the at least one spiked roller is configured to be adjustable along a transverse direction between the first end and the second end of the housing, to accommodate different thickness of the carpet tile.

12. The carpet tile lifting apparatus as claimed in claim 1, wherein the at least one spiked roller is configured to pull the lifted carpet tile rearwards, to clear space for the at least one wing for continuous lifting of new carpet tiles.

13. The carpet tile lifting apparatus as claimed in claim 1, wherein the first blade and the second blade, of the at least one wing, are spaced apart along a transverse direction.

14. The carpet tile lifting apparatus as claimed in claim 1, wherein the first blade of the at least one wing is configured to slide between the carpet tile and a floor.

15. The carpet tile lifting apparatus as claimed in claim 1, wherein the first blade of the at least one wing comprises a front edge having a hardened cutting edge which is configured to slide between the carpet tile and a floor to which the carpet tile is glued.

16. The carpet tile lifting apparatus as claimed in claim 15, wherein the front edge is detachably attached to the at least one wing using the second plurality of screws.

17. The carpet tile lifting apparatus as claimed in claim 16, wherein the front edge is configured to be inclined at an angle with the at least one wing, the angle of the front edge is configured to be adjusted using the second plurality of screws.

18. The carpet tile lifting apparatus as claimed in claim 1, further comprising at least two wings, coupled to the base plate on both sides, wherein each wing is configured to lift at least one carpet tile.

19. The carpet tile lifting apparatus as claimed in claim 1, further comprising an extended portion integrated on one side of the at least one wing, wherein the extended portion is provided with a first plurality of holes, the first plurality of holes is configured to be coupled with a second plurality of holes of the base plate using the first plurality of screws.

20. The carpet tile lifting apparatus as claimed in claim 19, wherein the base plate cover is provided with a third plurality of holes integrated on one side of the base plate cover, the third plurality of holes are configured to be coupled with the first plurality of holes of the extended portion and the second plurality of holes of the base plate.

21. A carpet tile lifting system comprising:

a carpet tile lifting apparatus;

a base plate and a base plate cover coupled to each other;

at least one wing coupled at one end with the base plate cover using a first plurality of screws, wherein the at least one wing comprises:

a first blade and a second blade coupled with each other using a second plurality of screws, the first blade is coupled with the base plate cover via the first plurality of screws, wherein the base plate is configured to press against a carpet tile and the at least one wing is configured to lift the carpet tile rearwards;

a housing coupled with the at least one wing, wherein the housing encloses:

a plurality of wheels coupled to a first end and a second end of the housing via a first shaft;

a first gear coupled to the first shaft;

a second gear interfaced with the first gear in a transverse direction;

a second shaft coupled with the second gear, wherein the second shaft is coupled between the first end and the second end of the housing; and at least one spiked roller coupled with the second shaft and interlocked between the first end and the second end of the housing, wherein the plurality of wheels impart motion to the at least one spiked roller via the first gear and the second gear, and the at least one spiked roller pulls the lifted carpet tile out of the carpet tile lifter;

wherein the carpet tile lifting apparatus having a clamping hook integrated at one side of the base plate; and a carpet pulling apparatus having a motorized winch coupled to the clamping hook of the base plate via a cable, wherein the carpet pulling apparatus is configured to pull the carpet lifting apparatus via the cable, the cable being attached to the motorized winch at a first end and to the clamping hook at a second end;

wherein the carpet lifting apparatus is configured to slide between a carpet tile and a floor to which the carpet tile is glued, and the carpet pulling apparatus is configured to impart motion to the carpet tile lifting apparatus via the cable using the motorized winch.

22. The system as claimed in claim 21, further comprising a diverter coupled to the cable between the first end and the second end, wherein the diverter is configured to divert the motion of the carpet tile lifting apparatus along the floor.

* * * * *